US007527089B2

(12) United States Patent
Gorbounov et al.

(10) Patent No.: US 7,527,089 B2
(45) Date of Patent: May 5, 2009

(54) HEAT EXCHANGER WITH MULTIPLE STAGE FLUID EXPANSION IN HEADER

(75) Inventors: Mikhail B. Gorbounov, South Windsor, CT (US); Joseph J. Sangiovanni, West Suffield, CT (US); Igor B. Vaisman, West Hartford, CT (US)

(73) Assignee: Carrier Corporation, Farmington, CT (US)

( * ) Notice: Subject to any disclaimer, the term of this patent is extended or adjusted under 35 U.S.C. 154(b) by 399 days.

(21) Appl. No.: 10/594,651

(22) PCT Filed: Dec. 28, 2005

(86) PCT No.: PCT/US2005/047362

§ 371 (c)(1),
(2), (4) Date: Sep. 27, 2006

(87) PCT Pub. No.: WO2006/083448

PCT Pub. Date: Aug. 10, 2006

(65) Prior Publication Data

US 2008/0251245 A1 Oct. 16, 2008

Related U.S. Application Data

(60) Provisional application No. 60/649,268, filed on Feb. 2, 2005.

(51) Int. Cl.
*F28F 9/22* (2006.01)

(52) U.S. Cl. ..... 165/174; 165/178; 62/511; 62/527

(58) Field of Classification Search ..... 165/174, 165/178; 62/511, 527
See application file for complete search history.

(56) References Cited

U.S. PATENT DOCUMENTS

| | | | | |
|---|---|---|---|---|
| 1,340,153 | A * | 5/1920 | Cardwell | 165/174 |
| 2,297,633 | A | 9/1942 | Philipp | |
| 2,591,109 | A | 4/1952 | Wade | |
| 3,920,069 | A | 11/1975 | Mosier | |
| 4,088,182 | A | 5/1978 | Basdekas et al. | |

(Continued)

FOREIGN PATENT DOCUMENTS

| | | |
|---|---|---|
| CN | 1611907 | 5/2005 |

(Continued)

*Primary Examiner*—Allen J Flanigan
(74) *Attorney, Agent, or Firm*—Marjama Muldoon Blasiak & Sullivan LLP

(57) ABSTRACT

A heat exchanger includes a plurality of flat, multi-channel heat exchange tubes extending between spaced headers. Each heat exchange tube has an inlet end in fluid flow communication with one of the headers and an outlet opening to the other header. Each heat exchange tube has a plurality of flow channels extending longitudinally in parallel relationship from its inlet end to its outlet end. A plurality of connectors are positioned between the inlet header and the heat transfer tubes to define a flow path providing fluid flow communication between the inlet header and the inlet ends of the heat exchange tubes. Two or more flow restriction ports are arranged in the series in the flow path through each connector whereby fluid flowing from the inlet header to the flow channels of the heat exchange tube associated therewith undergoes an expansion as the fluid passes through each flow restriction port.

19 Claims, 6 Drawing Sheets

U.S. PATENT DOCUMENTS

| | | | | |
|---|---|---|---|---|
| 4,202,182 | A * | 5/1980 | Kawashima et al. | 62/511 |
| 4,334,554 | A * | 6/1982 | Geiger et al. | 138/44 |
| 4,382,468 | A | 5/1983 | Hastwell et al. | |
| 4,497,363 | A | 2/1985 | Heronemus | |
| 4,524,823 | A * | 6/1985 | Hummel et al. | 165/174 |
| 4,607,689 | A | 8/1986 | Mochida et al. | |
| 4,724,904 | A * | 2/1988 | Fletcher et al. | 165/174 |
| 5,320,165 | A | 6/1994 | Hughes | |
| 5,341,870 | A | 8/1994 | Hughes et al. | |
| 5,415,223 | A | 5/1995 | Reavis et al. | |
| 5,517,757 | A | 5/1996 | Hayashi et al. | |
| 5,632,329 | A | 5/1997 | Fay | |
| 5,743,329 | A | 4/1998 | Damsohn et al. | |
| 5,826,649 | A | 10/1998 | Chapp et al. | |
| 5,934,367 | A | 8/1999 | Shimmura et al. | |
| 5,941,303 | A | 8/1999 | Gowan et al. | |
| 5,967,228 | A | 10/1999 | Bergman et al. | |
| 5,971,065 | A | 10/1999 | Bertilson et al. | |
| 6,340,055 | B1 | 1/2002 | Yamauchi et al. | |
| 6,546,998 | B2 | 4/2003 | Oh et al. | |
| 6,564,863 | B1 * | 5/2003 | Martins | 165/175 |
| 6,688,137 | B1 | 2/2004 | Gupte | |
| 6,688,138 | B2 | 2/2004 | DiFlora | |
| 2001/0004935 | A1 | 6/2001 | Sanada et al. | |
| 2003/0116308 | A1 | 6/2003 | Watanabe et al. | |
| 2003/0155109 | A1 | 8/2003 | Kawakubo et al. | |
| 2005/0051318 | A1 * | 3/2005 | Fujita et al. | 165/178 |

FOREIGN PATENT DOCUMENTS

| | | | |
|---|---|---|---|
| EP | 0228330 | | 7/1987 |
| FR | 1258044 | | 4/1961 |
| FR | 2777645 | * | 10/1999 |
| JP | 62147296 A | * | 7/1987 |
| JP | 2217764 | | 8/1990 |
| JP | 4080575 | | 3/1992 |
| JP | 6241682 | | 9/1994 |
| JP | 7301472 | | 11/1995 |
| JP | 8233409 | | 9/1996 |
| JP | 11351706 | | 12/1999 |
| JP | 2002022313 | | 1/2002 |
| JP | WO-0242707 | | 5/2002 |

* cited by examiner

HEAT EXCHANGER WITH MULTIPLE STAGE FLUID EXPANSION IN HEADER

CROSS-REFERENCE TO RELATED APPLICATION

Reference is made to and this application claims priority from and the benefit of U.S. Provisional Application Ser. No. 60/649,268, filed Feb. 2, 2005, and entitled MINI-CHANNEL HEAT EXCHANGER WITH MULTI-STAGE EXPANSION DEVICE, which application is incorporated herein in its entirety by reference.

FIELD OF THE INVENTION

This invention relates generally to heat exchangers having a plurality of parallel tubes extending between a first header and a second header, also sometimes referred to as manifolds, and, more particularly, to providing fluid expansion within the header of a heat exchanger for improving distribution of two-phase flow through the parallel tubes of the heat exchanger, for example a heat exchanger in a refrigerant compression system.

BACKGROUND OF THE INVENTION

Refrigerant vapor compression systems are well known in the art. Air conditioners and heat pumps employing refrigerant vapor compression cycles are commonly used for cooling or cooling/heating air supplied to a climate controlled comfort zone within a residence, office building, hospital, school, restaurant or other facility. Refrigeration vapor compression systems are also commonly used for cooling air or other secondary fluid to provide a refrigerated environment for food items and beverage products within, for instance, display cases in supermarkets, convenience stores, groceries, cafeterias, restaurants and other food service establishments.

Conventionally, these refrigerant vapor compression systems include a compressor, a condenser, an expansion device, and an evaporator connected in refrigerant flow communication. The aforementioned basic refrigerant system components are interconnected by refrigerant lines in a closed refrigerant circuit and arranged in accord with the vapor compression cycle employed. An expansion device, commonly an expansion valve or a fixed-bore metering device, such as an orifice or a capillary tube, is disposed in the refrigerant line at a location in the refrigerant circuit upstream, with respect to refrigerant flow, of the evaporator and downstream of the condenser. The expansion device operates to expand the liquid refrigerant passing through the refrigerant line running from the condenser to the evaporator to a lower pressure and temperature. In doing so, a portion of the liquid refrigerant traversing the expansion device expands to vapor. As a result, in conventional refrigerant vapor compression systems of this type, the refrigerant flow entering the evaporator constitutes a two-phase mixture. The particular percentages of liquid refrigerant and vapor refrigerant depend upon the particular expansion device employed and the refrigerant in use, for example R12, R22, R134a, R404A, R410A, R407C, R717, R744 or other compressible fluid.

In some refrigerant vapor compression systems, the evaporator is a parallel tube heat exchanger. Such heat exchangers have a plurality of parallel refrigerant flow paths therethrough provided by a plurality of tubes extending in parallel relationship between an inlet header and an outlet header. The inlet header receives the refrigerant flow from the refrigerant circuit and distributes it amongst the plurality of flow paths through the heat exchanger. The outlet header serves to collect the refrigerant flow as it leaves the respective flow paths and to direct the collected flow back to the refrigerant line for a return to the compressor in a single pass heat exchanger or through an additional bank of heat exchange tubes in a multi-pass heat exchanger.

Historically, parallel tube heat exchangers used in such refrigerant compression systems have used round tubes, typically having a diameter of ½ inch, ⅜ inch or 7 millimeters. More recently, flat, rectangular or oval shape, multi-channel tubes are being used in heat exchangers for refrigerant vapor compression systems. Each multi-channel tube has a plurality of flow channels extending longitudinally in parallel relationship the length of the tube, each channel providing a small cross-sectional flow area refrigerant path. Thus, a heat exchanger with multi-channel tubes extending in parallel relationship between the inlet and outlet headers of the heat exchanger will have a relatively large number of small cross-sectional flow area refrigerant paths extending between the two headers. In contrast, a parallel tube heat exchanger with conventional round tubes will have a relatively small number of large flow area flow paths extending between the inlet and outlet headers.

Non-uniform distribution, also referred to as maldistibution, of two-phase refrigerant flow is a common problem in parallel tube heat exchangers which adversely impacts heat exchanger efficiency. Among other factors, two-phase maldistribution problems are caused by the difference in density of the vapor phase refrigerant and the liquid phase refrigerant present in the inlet header due to the expansion of the refrigerant as it traversed the upstream expansion device.

One solution to control refrigeration flow distribution through parallel tubes in an evaporative heat exchanger is disclosed in U.S. Pat. No. 6,502,413, Repice et al. In the refrigerant vapor compression system disclosed therein, the high pressure liquid refrigerant from the condenser is partially expanded in a conventional in-line expansion device upstream of the heat exchanger inlet header to a lower pressure refrigerant. Additionally, a restriction, such as a simple narrowing in the tube or an internal orifice plate disposed within the tube, is provided in each tube connected to the inlet header downstream of the tube inlet to complete the expansion to a low pressure, liquid/vapor refrigerant mixture after entering the tube.

Another solution to control refrigeration flow distribution through parallel tubes in an evaporative heat exchanger is disclosed in Japanese Patent No. JP4080575, Kanzaki et al. In the refrigerant vapor compression system disclosed therein, the high pressure liquid refrigerant from the condenser is also partially expanded in a conventional in-line expansion device to a lower pressure refrigerant upstream of a distribution chamber of the heat exchanger. A plate having a plurality of orifices therein extends across the chamber. The lower pressure refrigerant expands as it passes through the orifices to a low pressure liquid/vapor mixture downstream of the plate and upstream of the inlets to the respective tubes opening to the chamber.

Japanese Patent No. 6241682, Massali et al., discloses a parallel flow tube heat exchanger for a heat pump wherein the inlet end of each multichannel tube connecting to the inlet header is crushed to form a partial throttle restriction in each tube just downstream of the tube inlet. Japanese Patent No. JP8233409, Hiroaki et al., discloses a parallel flow tube heat exchanger wherein a plurality of flat, multi-channel tubes connect between a pair of headers, each of which has an interior which decreases in flow area in the direction of refrigerant flow as a means to uniformly distribute refrigerant to the respective tubes. Japanese Patent No. JP2002022313, Yasushi, discloses a parallel tube heat exchanger wherein refrigerant is supplied to the header through an inlet tube that extends along the axis of the header to terminate short of the end the header whereby the two phase refrigerant flow does not separate as it passes from the inlet tube into an annular channel between the outer surface of the inlet tube and the inside surface of the header. The two phase refrigerant flow thence passes into each of the tubes opening to the annular channel.

Obtaining uniform refrigerant flow distribution amongst the relatively large number of small cross-sectional flow area refrigerant flow paths is even more difficult than it is in conventional round tube heat exchangers and can significantly reduce heat exchanger efficiency.

SUMMARY OF THE INVENTION

It is a general object of the invention to reduce maldistribution of fluid flow in a heat exchanger having a plurality of multi-channel tubes extending between a first header and a second header.

It is an object of one aspect of the invention to reduce maldistribution of refrigerant flow in a refrigerant vapor compression system heat exchanger having a plurality of multi-channel tubes extending between a first header and a second header.

It is an object of one aspect of the invention to distribute refrigerant to the individual channels of an array of multi-channel tubes in a relatively uniform manner.

It is an object of another aspect of the invention to provide for distribution and expansion of the refrigerant in a refrigerant vapor compression system heat exchanger having a plurality of multi-channel tubes as the refrigerant flow passes from a header to the individual channels of an array of multi-channel tubes.

In one aspect of the invention, a heat exchanger is provided having a header defining a chamber for receiving a fluid and at least one heat exchange tube having a plurality of fluid flow paths therethrough from an inlet end to an outlet end of the tube and having an inlet opening to the plurality of fluid flow paths. A connector is provided having an inlet end and an outlet end and defining an inlet chamber at its inlet end in fluid flow communication with the fluid chamber of the header, an outlet chamber at its outlet end in fluid communication with the inlet opening of the at least one heat exchange tube, and an intermediate chamber defining a flow path between said inlet chamber and said outlet chamber. The flow path has a plurality of flow restriction ports disposed therein in a spaced series arrangement. Fluid flow passing from the header to the flow channels of the at least one heat exchange tube will undergo a series of fluid expansions in passing through the flow restriction ports provided in the flow path through the connector. In an embodiment, each flow restriction port is a straight walled, cylindrical opening. In another embodiment, each flow restriction port is a contoured opening.

In another aspect of the invention, a refrigerant vapor compression system includes a compressor, a condenser and an evaporative heat exchanger connected in refrigerant flow communication whereby high pressure refrigerant vapor passes from the compressor to the condenser, high pressure refrigerant liquid passes from the condenser to the evaporative heat exchanger, and low pressure refrigerant vapor passes from the evaporative heat exchanger to the compressor. The evaporative heat exchanger includes an inlet header and an outlet header, and a plurality of heat exchange tubes extending between the headers. The inlet header defines a chamber for receiving liquid refrigerant from a refrigerant circuit. Each heat exchange tube has an inlet end, an outlet end, and a plurality of fluid flow paths extending from an inlet opening at the inlet end to an outlet opening at the outlet end of the tube. A connector is provided having an inlet end and an outlet end and defining an inlet chamber at its inlet end in fluid flow communication with the fluid chamber of the inlet header, an outlet chamber at its outlet end in fluid communication with the inlet opening of the at least one heat exchange tube, and an intermediate chamber defining a flow path between said inlet chamber and said outlet chamber. The flow path has a plurality of flow restriction ports disposed therein in a spaced series arrangement. Fluid flow passing from the header to the flow channels of the heat exchange tube will undergo a series of fluid expansions in passing through the flow restriction ports provided in the flow path through the connector. In an embodiment, each flow restriction port is a straight walled, cylindrical opening. In another embodiment, each flow restriction port is a contoured opening.

In a further aspect of the invention, a refrigeration vapor compression system is provided having a compressor, a first heat exchanger and a second heat exchanger connected in fluid flow communication in a refrigerant circuit. When the system is operated in a cooling mode, refrigerant circulates in a first direction from the compressor through the first heat exchanger, functioning as a condenser, thence through the second high exchanger, functioning as an evaporator, and back to the compressor. When the system is operated in a heating mode, refrigerant circulates in a second direction from the compressor through the second heat exchanger, now functioning as a condenser, thence through the first heat exchanger, now functioning as an evaporator, and back to the compressor. Each heat exchanger has a first header, a second header, and at least one beat exchange tube defining a plurality of discrete fluid flow paths extending between a first end of the tube and a second end of the tube.

In an embodiment, the second heat exchanger includes a connector having an inlet end and an outlet end and defining an inlet chamber at its inlet end, an outlet chamber at its outlet end, and an intermediate chamber defining a flow path between the inlet chamber and the outlet chamber. The inlet chamber of the connector is in fluid flow communication with the first header and the outlet chamber is in fluid flow communication the plurality of discrete fluid flow paths of the heat exchange tube. The flow path includes a plurality of flow restriction ports disposed therein in a spaced series arrangement and adapted to create a relatively large pressure drop in refrigerant flow passing in the first direction and a relatively small pressure drop in refrigerant flow passing in the second direction.

In an embodiment, the first heat exchanger includes a connector having an inlet end and an outlet end and defining an inlet chamber at its inlet end in fluid flow communication with the fluid chamber of the second header, an outlet chamber at its outlet end in fluid communication with the plurality of discrete fluid flow paths of the at least one heat exchange tube, and an intermediate chamber defining a flow path between the inlet chamber and the outlet chamber. The flow path includes a plurality of flow restriction ports disposed therein in a spaced series arrangement and adapted to create a relatively small pressure drop in refrigerant flow passing in the first direction and a relatively large pressure drop in refrigerant flow passing in the second direction.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
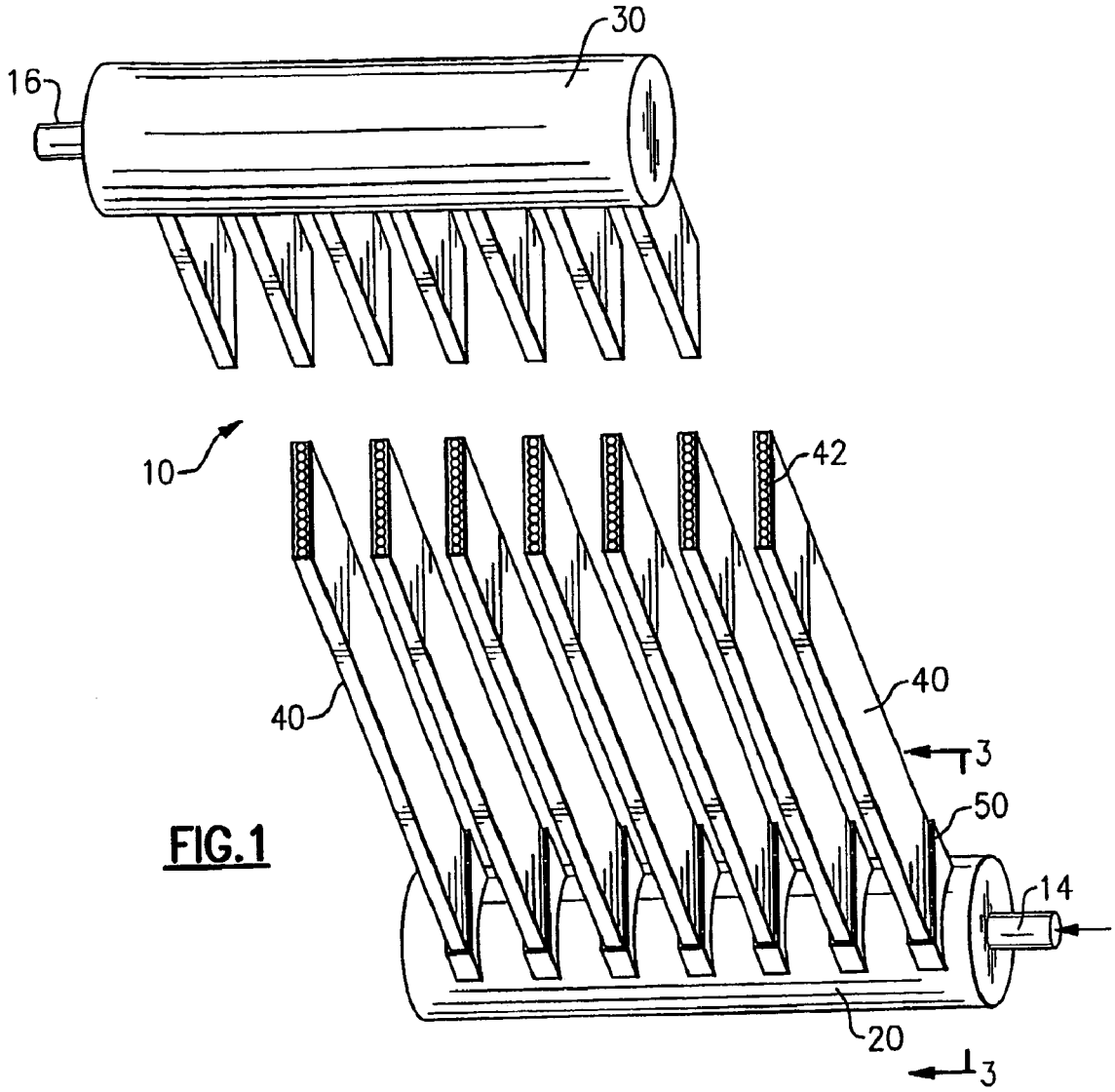
FIG. 1 is a perspective view of an embodiment of a heat exchanger in accordance with the invention.
Figure 2:
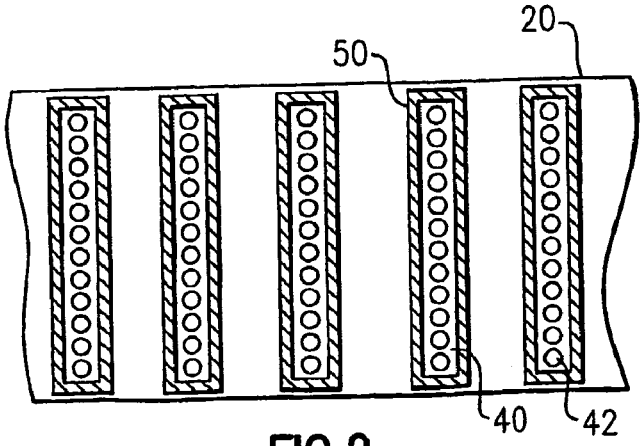
FIG. 2 is a plan view, partly sectioned, taken along line 2-2 of FIG. 3.

The heat exchanger 10 of the invention will be described in general herein with reference to the illustrative single pass, parallel-tube embodiment of a multi-channel tube heat exchanger as depicted in FIGS. 1 and 2. In the illustrative embodiment of the heat exchanger 10 depicted in FIGS. 1 and 2, the heat exchange tubes 40 are shown arranged in axially spaced, parallel relationship extending generally vertically between a generally horizontally extending inlet header 20 and a generally horizontally extending outlet header 30. However, the depicted embodiment is illustrative and not limiting of the invention. It is to be understood that the invention described herein may be practiced on various other configurations of the heat exchanger 10. For example, the heat exchange tubes may be arranged in parallel relationship extending generally horizontally between a generally vertically extending inlet header and a generally vertically extending outlet header. As a further example, the heat exchanger could have a toroidal inlet header and a toroidal outlet header of a different diameter with the heat exchange tubes extend either somewhat radially inwardly or somewhat radially outwardly between the toroidal headers. The heat exchange tubes may also be arranged in parallel tube, multi-pass embodiments, as will be discussed in further detail later herein with reference to FIGS. 13 and 14.

The heat exchanger 10 includes an inlet header 20, an outlet header 30, and a plurality of longitudinally extending multi-channel heat exchanger tubes 40 thereby providing a plurality of fluid flow paths between the inlet header 20 and the outlet header 30. Each heat exchange tube 40 has an inlet at one end in fluid flow communication to the inlet header 20 through a connector 50 and an outlet at its other end in fluid flow communication to the outlet header 30. Each heat exchange tube 40 has a plurality of parallel flow channels 42 extending longitudinally, i.e. along the axis of the tube, the length of the tube thereby providing multiple, independent, parallel flow paths between the inlet of the tube and the outlet of the tube. Each multi-channel heat exchange tube 40 is a "flat" tube of, for instance, rectangular or oval cross-section, defining an interior which is subdivided to form a side-by-side array of independent flow channels 42. The flat, multi-channel tubes 40 may, for example, have a width of fifty millimeters or less, typically twelve to twenty-five millimeters, and a height of about two millimeters or less, as compared to conventional prior art round tubes having a diameter of ½ inch, ⅜ inch or 7 mm. The tubes 40 are shown in drawings hereof, for ease and clarity of illustration, as having twelve channels 42 defining flow paths having a circular cross-section. However, it is to be understood that in commercial applications, such as for example refrigerant vapor compression systems, each multi-channel tube 40 will typically have about ten to twenty flow channels 42, but may have a greater or a lesser multiplicity of channels, as desired. Generally, each flow channel 42 will have a hydraulic diameter, defined as four times the flow area divided by the perimeter, in the range from about 200 microns to about 3 millimeters. Although depicted as having a circular cross-section in the drawings, the channels 42 may have a rectangular, triangular, trapezoidal cross-section or any other desired non-circular cross-section.

Referring now to FIGS. 3-8, in particular, each of the plurality of heat exchange tubes 40 of the heat exchanger 10 has its inlet end 43 inserted into a connector 50, rather than directly into the chamber 25 defined within the inlet header 20. Each connector 50 is inserted into a corresponding slot 26 provided in and extending through the wall of the inlet header 20 with the inlet end 52 of the connector 50 inserted into its corresponding slot. Each connector may be brazed, welded, soldered, adhesively bonded, diffusion bonded or otherwise secured in its respective corresponding mating slot in the wall of the header 20. Each connector 50 has an inlet end 52 and an outlet end 54 and defines a fluid flow path extending from the inlet end 52 to the outlet end 54. The inlet end 52 is in fluid flow communication with the chamber 25 of the inlet header 20 through an inlet chamber 51. The outlet end 54 is in fluid communication through an outlet chamber 53 with the inlet openings 41 of the channels 42 the associated heat transfer tube 40 received therein.

Each connector 50 defines a flow path comprising the inlet chamber 51, the outlet chamber 53, and an intermediate section extending from the inlet chamber 51 at the inlet end 52 of the connector to the outlet chamber 53 at the outlet end 54 of the connector. Fluid collecting in the fluid chamber 25 of the header 20 passes therefrom into the inlet chamber 51, thence through the intermediate section and through the outlet chamber 53 to be distributed to the individual channels 42 of the heat exchange tubes 40. The intermediate section of the flow path through each connector 50 is provided with at least two flow restriction ports 56 that serve as expansion orifices. The at least two flow restriction ports 56 are arranged in series with respect to fluid flow through the intermediate section. An expansion chamber 57 is disposed between each pair of sequentially arrayed flow restriction ports 56. The expansion chamber 57 may have a cross-sectional flow area that is approximately equal to or at least on the same order as the cross-sectional flow area of the inlet chamber 51. The flow restriction ports 56, on the other hand, have a cross-section flow area that is relatively small in comparison to the cross-section flow area of the expansion chamber 57.

As the fluid flowing from the chamber 25 of the header 20 flows through the intermediate section, the fluid undergoes an expansion as it passes through each of the flow restriction ports 56. Thus, the fluid undergoes multiple expansions commensurate with the number of flow restriction orifices provided in the flow path through the connector 50 before the fluid passes into the outlet chamber 53 of the connector for distribution to the channels 42 of the heat exchange tube 40 associated with the connector. Inasmuch as the pressure drop produced in a fluid flow by an orifice restriction is created as a result of momentum exchange in the fluid at the inlet and at the outlet of the orifice, the fluid pressure drop created by an orifice restriction is inversely proportional to the orifice size or dimension, a larger port will produce a lower pressure drop. Since the fluid undergoes multiple stages of expansion, at least two expansions in accord with the invention, the individual flow restriction ports 56 may be sized somewhat larger than would be necessary if the same degree of expansion were to be obtained through a single orifice. Further, with a connector 50 operatively associated with each heat transfer tube 40, the flow restriction ports 56 provide relative uniformity in pressure drop in the fluid flowing from the chamber 25 of the header 20 into the outlet chamber 53 within each connector 50, thereby ensuring a relatively uniform distribution of fluid amongst the individual tubes 40 operatively associated with the header 20.

Figure 3:
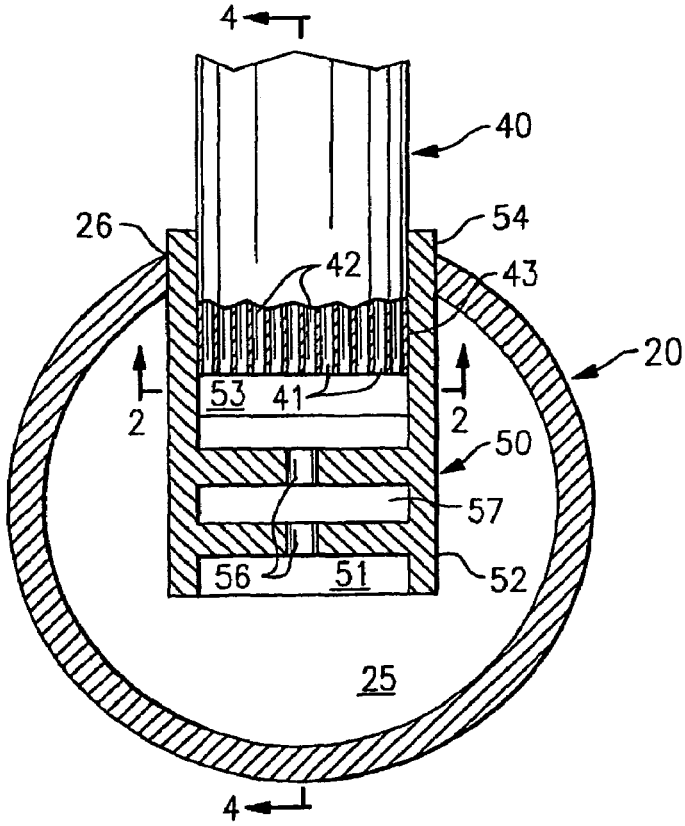
FIG. 3 is a sectioned view taken along line 3-3 of FIG. 1.
Figure 4:
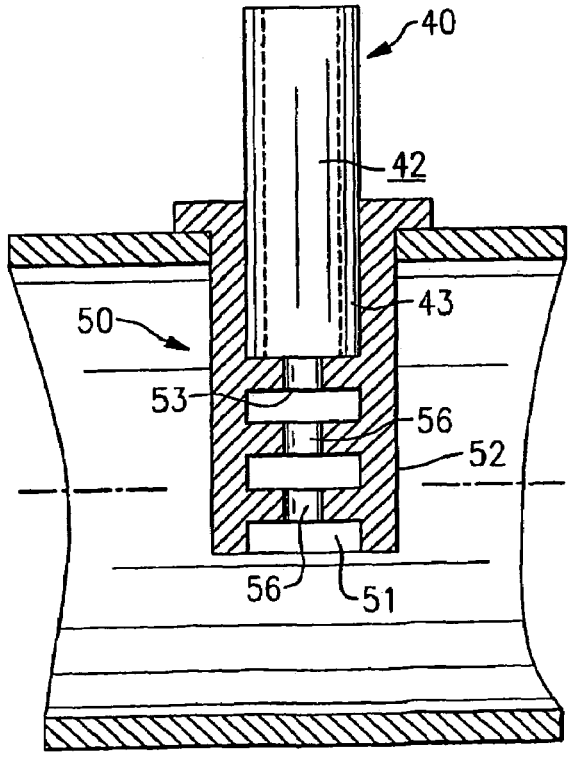
FIG. 4 is a sectioned view taken along line 4-4 of FIG. 3.
Figure 5:
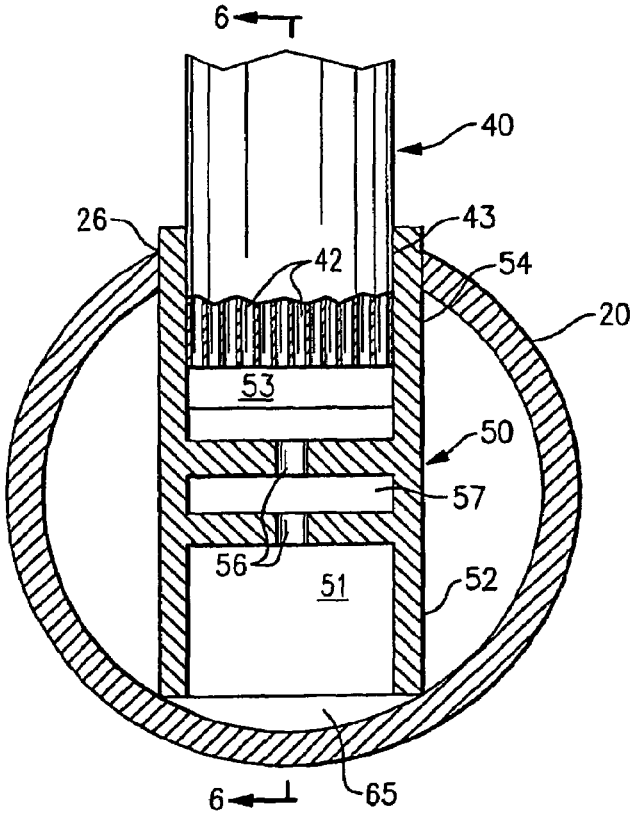
FIG. 5 is an elevation view, partly sectioned, showing an alternate embodiment of a heat exchanger in accordance with the invention.
Figure 6:
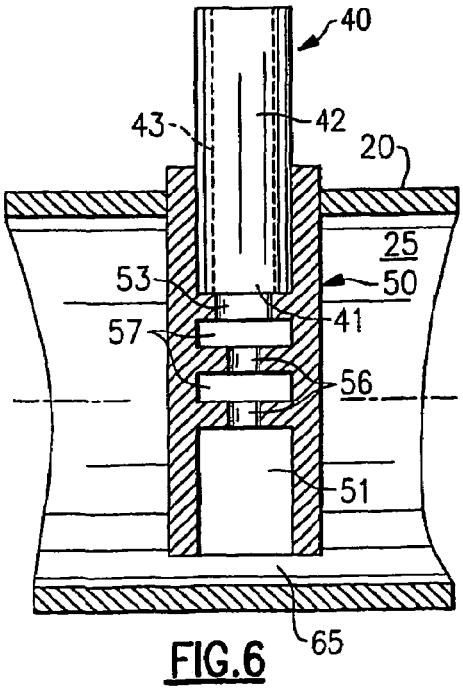
FIG. 6 is a sectioned view taken along line 6-6 of FIG. 5.

In the embodiments depicted in FIGS. 3-6, the header 20 comprises a longitudinally elongated, hollow, closed end, pipe having a circular cross-section. In the embodiment of FIGS. 3 and 4, the connector 50 extends into chamber 25 of the header 20.for only somewhat more than half the diameter of the header with the inlet chamber 51 spaced from the opposite inside surface of the header 20. The fluid collecting in the header 20 flows without restriction into the inlet chamber 51. In the embodiment of FIGS. 5 and 6, the connector 50 extends into the chamber 25 of the header 20 across the chamber 25 such that the lateral sides of the inlet end 52 of the connector 50 rests upon the opposite inside surface of the header 20 for additional support. With the lateral sides of the inlet end 52 in contact with the opposite inside surface of the header 20, a space 65 is created between the inlet chamber 51 of the connector 50 and the inside surface of the header 20 due to the curvature of the wall of the header 20. The fluid collecting in the header 20 flows from the chamber through this space 65 in order to enter the inlet chamber 51 of the header 20.

Figure 7:
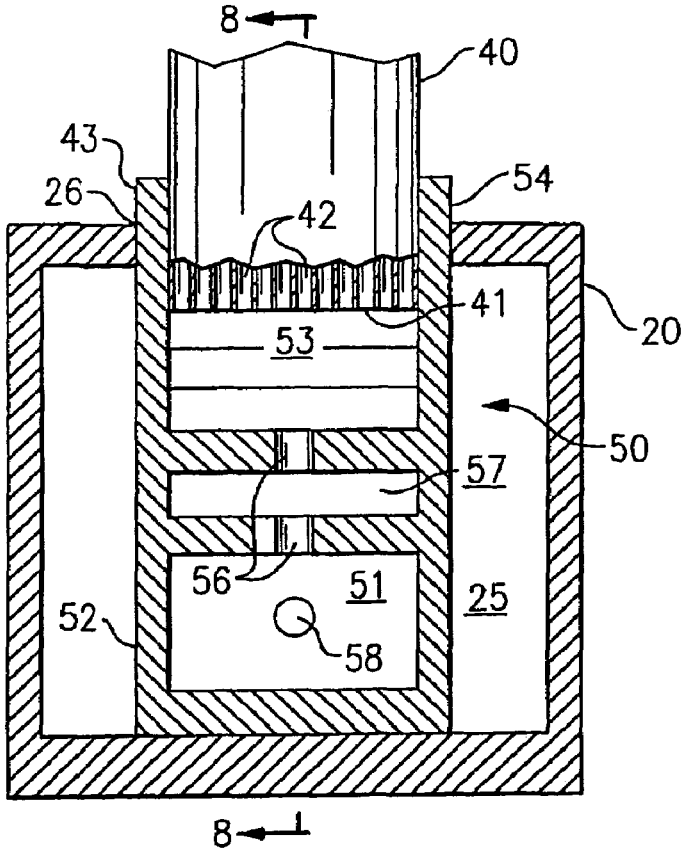
FIG. 7 is an elevation view, partly sectioned, of an another embodiment of a heat exchanger in accordance with the invention.
Figure 8:
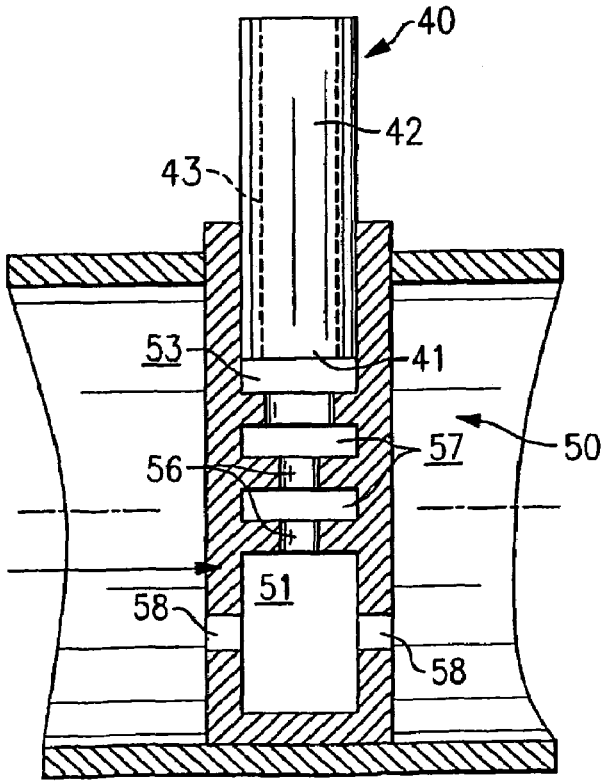
FIG. 8 is a sectioned view taken along line 8-8 of FIG. 7.

In the embodiments depicted in FIGS. 7-8, the header 20 comprises a longitudinally elongated, hollow, closed end, pipe having a rectangular or square cross-section. The connector 50 extends into the chamber 25 of the header 20 across the chamber 25 such that the inlet end 52 of the connector 50 contacts and rests upon the opposite inside surface of the header 20. One or more inlet ports 58 are provided in the side walls of the inlet end 52 of the connector 50 through which fluid collecting in the header 20 flows from the chamber 25 to enter the inlet chamber 51 of the header 20. Each inlet port 5 8 may be sized to function as an addition expansion orifice upstream of the flow restriction ports 56 to provide for an initial expansion of the fluid as it enters the inlet chamber 51 of the connector 50.

Figure 9:
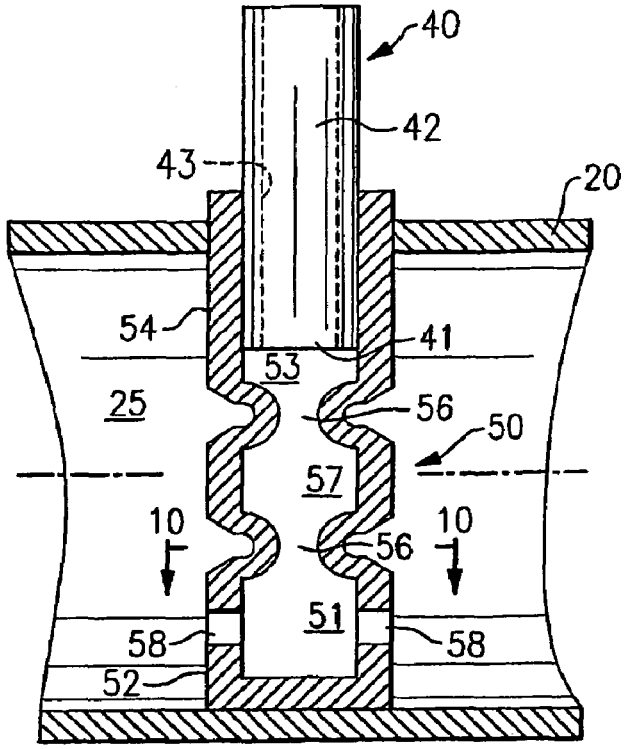
FIG. 9 is a sectioned view showing an alternate embodiment of the connector of FIG. 8.
Figure 10:
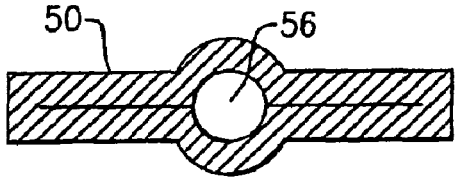
FIG. 10 is a sectioned view taken along line 10-10 of FIG. 9.

To provide the series arrangement of alternate flow restriction ports 56 and expansion chambers 57 between the inlet chamber 51 and the outlet chamber 53 in the embodiments of the connector 50 depicted in FIGS. 3-8, the connector 50 is formed using conventional casting procedures. In the embodiment of the connector 50 depicted in FIGS. 9 and 10, the connector 50 is formed by an extrusion process to produce a flat rectangular tube and a pressing or stamping process to create the spaced flow restriction ports 56. By using a pressing or stamping process, the restriction ports 56 are profiled, rather than being straight walled, cylindrical ports.

Figure 12:
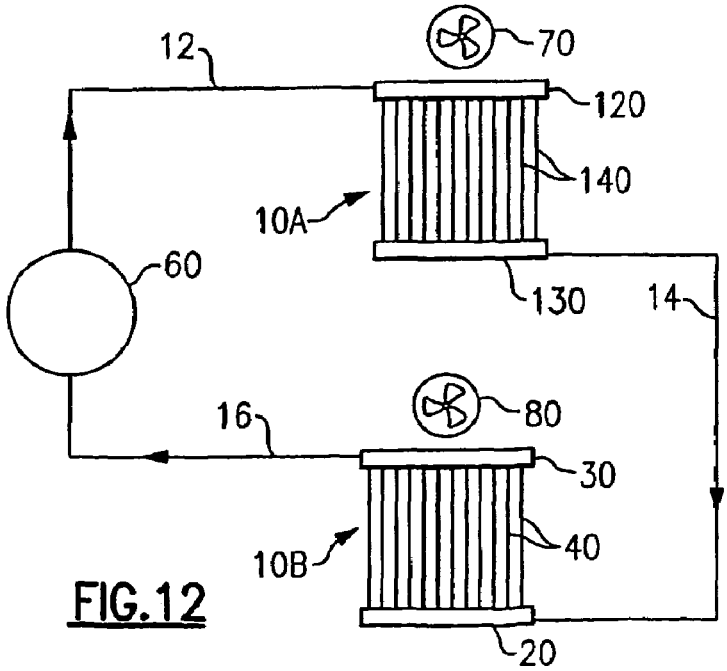
FIG. 12 is a schematic illustration of a refrigerant vapor compression system incorporating the heat exchanger of the invention.

Referring now to FIG. 12, there is depicted schematically a refrigerant vapor compression system having a compressor 60, the heat exchanger 10A, functioning as a condenser, and the heat exchanger 10B, functioning as an evaporator, connected in a closed loop air conditioning, cooling mode, refrigerant circuit by refrigerant lines 12, 14 and 16. As in conventional refrigerant vapor compression systems, the compressor 60 circulates hot, high pressure refrigerant vapor through refrigerant line 12 into the header 120 of the condenser 10A, and thence through the heat exchanger tubes 40 of the condenser 10A wherein the hot refrigerant vapor condenses to a liquid as it passes in heat exchange relationship with a cooling fluid, such as ambient air which is passed over the heat exchange tubes 40 by a condenser fan 70. The high pressure, liquid refrigerant collects in the header 130 of the condenser 10A and thence passes through refrigerant line 14 to the header 20 of the evaporator 10B. The refrigerant thence passes through the heat exchanger tubes 40 of the evaporator 10B wherein the refrigerant is heated as it passes in heat exchange relationship with air to be cooled which is passed over the heat exchange tubes 40 by an evaporator fan 80. The refrigerant vapor collects in the header 30 of the evaporator 10B and passes therefrom through refrigerant line 16 to return to the compressor 60 through the suction inlet thereto.

The condensed refrigerant liquid passes from the condenser 10A directly to the evaporator 10B without traversing an expansion device. Thus, in this embodiment, the refrigerant typically enters the header 20 of the evaporative heat exchanger 10B as a high pressure, liquid-phase only refrigerant. Expansion of the refrigerant will occur only within the evaporator 10B of the invention as the refrigerant passes through the flow restriction ports 56, and the inlet ports 58 if provided, thereby ensuring that expansion occurs only after the refrigerant has been distributed amongst the heat exchange tubes 40 opening into the header 20 in a substantially uniform manner as a single-phase, liquid.

Figure 13:
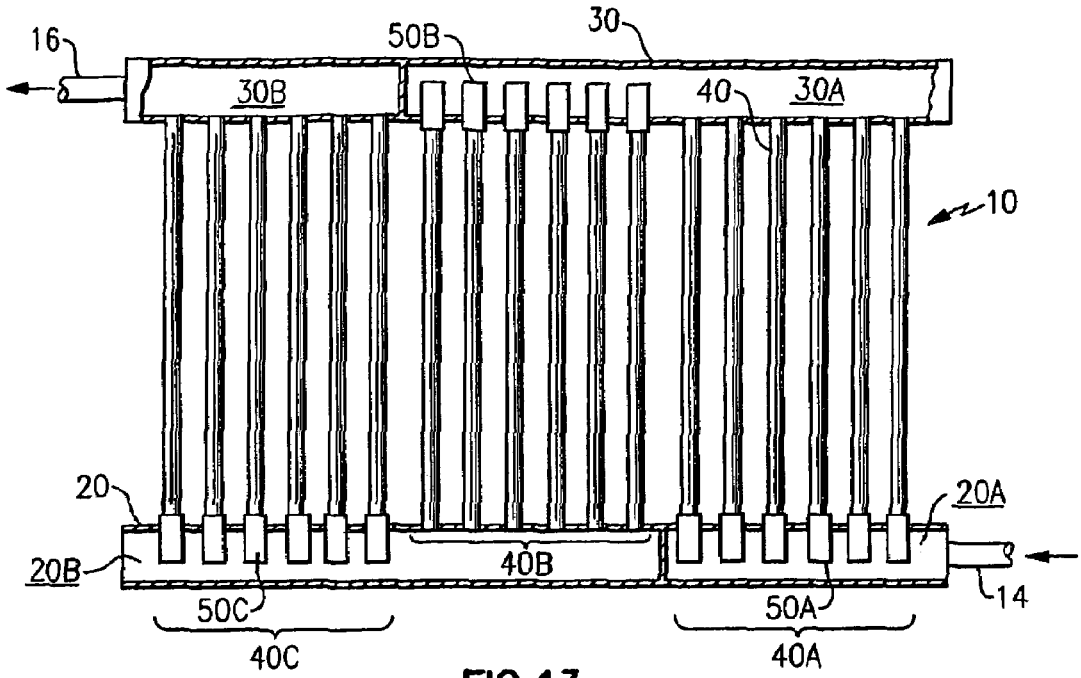
FIG. 13 is an elevation view, partly in section, of an embodiment of a multi-pass evaporator in accordance with the invention.

Referring now to FIG. 13, the heat exchanger 10 of the invention is depicted in a multi-pass, evaporator embodiment. In the illustrated multi-pass embodiment, the header 20 is partitioned into a first chamber 20A and a second chamber 20B, the header 30 is also partitioned into a first chamber 30A and a second chamber 30B, and the heat exchange tubes 40 are divided into three banks 40A, 40B and 40C. The heat exchange tubes of the first tube bank 40A have inlet ends inserted into respective connectors 50A that are open into the first chamber 20A of the header 20 and outlet ends are open to the first chamber 30A of the header 30. The heat exchange tubes of the second tube bank 40B have inlet ends inserted into respective connectors 50B that are open into the first chamber 30A of the header 30 and outlet ends are open to the second chamber 20B of the header 20. The heat exchange tubes of the third tube bank 40C have inlet ends inserted into respective connectors 50C that open into the second chamber 20B of the header 20 and outlet ends are open to the second chamber 30B of the header 30. In this manner, refrigerant entering the heat exchanger from refrigerant line 14 passes in heat exchange relationship with air passing over the exterior of the heat exchange tubes 40 three times, rather than once as in a single pass heat exchanger. In accord with the invention, the inlet end 43 of each of the tubes of the first, second and third tube banks 40A, 40B and 40C is inserted into the outlet end 54 of its associated connector 50 whereby the channels 42 of each of the tubes 40 will receive a relatively uniform distribution of expanded refrigerant liquid/vapor mixture. Distribution and expansion of the refrigerant occurs as the refrigerant passes from the header through the connectors 50, not only as the refrigerant passes into the first tube bank 40A, but also as the refrigerant passes into the second tube bank 40B and into the third tube bank 40C, thereby ensuring more uniform distribution of the refrigerant liquid/vapor upon entering the flow channels of the tubes of each tube bank.

Figure 14:
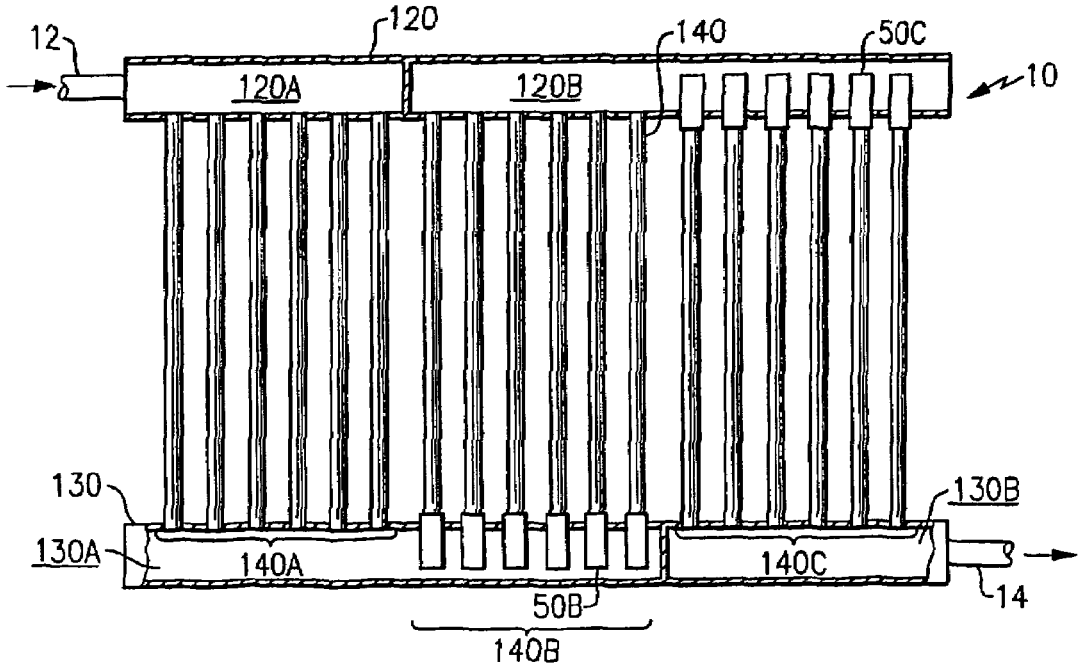
FIG. 14 is an elevation view, partly in section, of an embodiment of a multi-pass condenser in accordance with the invention.

Referring now to FIG. 14, the heat exchanger 10 of the invention is depicted in a multi-pass, condenser embodiment. In the illustrated multi-pass embodiment, the header 120 is partitioned into a first chamber 120A and a second chamber 120B, the header 130 is also partitioned into a first chamber 130A and a second chamber 130B, and the heat exchange tubes 140 are divided into three banks 140A, 140B and 140C. The heat exchange tubes of the first tube bank 140A have inlet end openings into the first chamber 120A of the header 120 and outlet end openings to the first chamber 130A of the header 130. The heat exchange tubes of the second tube bank 140B have inlet ends inserted into respective connectors 50B that are open into the first chamber 130A of the header 130 and outlet ends that are open to the second chamber 120B of the header 120. The heat exchange tubes of the third tube bank 140C have inlet ends inserted into respective connectors 50C that are open into the second chamber 120B of the header 120 and outlet ends are open to the second chamber 130B of the header 130. In this manner, refrigerant entering the condenser from refrigerant line 12 passes in the heat exchange relationship with air passing over the exterior of the heat exchange tubes 140 three times, rather than once as in a single pass heat exchanger. The refrigerant entering the first chamber 120A of the header 120 is entirely high pressure, refrigerant vapor directed from the compressor outlet via refrigerant line 14. However, the refrigerant entering the second tube bank and the third tube bank typically will be a liquid/vapor mixture as refrigerant partially condenses in passing through the first and second tube banks. In accord with the invention, the inlet end of each of the tubes of the second and third tube banks 140B, 140C is inserted into the outlet ends of their associated connectors 50B, 50C whereby the channels 42 of each of the tubes will receive a relatively uniform distribution of expanded refrigerant liquid/vapor mixture. Obviously, it has to be noted that pressure drop through the flow restriction ports 56 of each connector 50 has to be limited to not exceed a predetermined threshold for the condenser applications, in order not to compromise the heat exchanger efficiency. Further, a person ordinarily skilled in the art would understand that other multi-pass arrangements for condensers and evaporators are also within the scope of the invention.

It is to be understood that although an equal number of heat exchange tubes is shown in FIGS. 13 and 14 in each tube bank of the multi-pass heat exchanger 10, this number can be varied dependant on the relative amount of vapor and liquid refrigerant flowing through the particular tube bank. Typically, the higher the vapor content in the refrigerant mixture, the greater the number of heat exchange tubes included in that particular tube bank to assure appropriate pressure drop through the tube bank.

In the embodiments of the heat exchanger of the invention depicted and described herein, the inlet header 20 comprises a longitudinally elongated, hollow, closed end pipe having either a circular cross-section or a rectangular cross-section. However, neither the inlet header, nor the outlet header, is limited to the depicted configuration. For example, the headers might comprise longitudinally elongated, hollow, closed end pipes having an elliptical cross-section, a hexagonal cross-section, an octagonal cross-section, or a cross-section of other shape.

Figure 11:
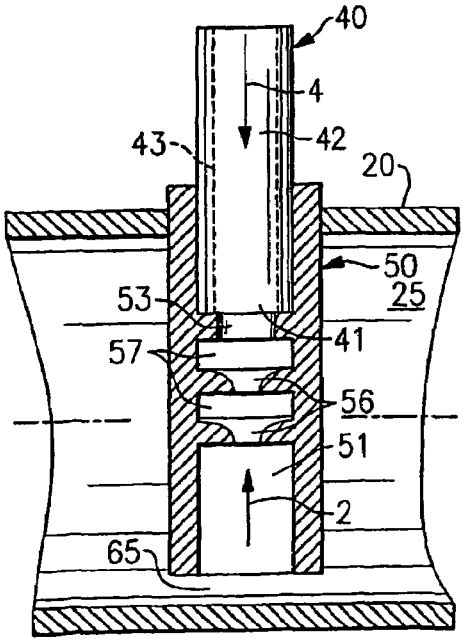
FIG. 11 is a sectioned view showing an alternate embodiment of the connector of FIG. 6.

Although the exemplary refrigerant vapor compression cycle illustrated in FIG. 12 is a simplified cooling mode, air conditioning cycle, it is to be understood that the heat exchanger of the invention may be employed in refrigerant vapor compression systems of various designs, including, without limitation, heat pump cycles, economized cycles and refrigeration cycles. For example, for use of the heat exchangers 10A and 10B of FIG. 12 in a heat pump cycle, the heat exchanger 10A must be designed to function as a condenser when the heat pump cycle is operated in the cooling mode and as an evaporator when the heat pump cycle is operated in the heating mode, while the heat exchanger 10B must be designed to function as an evaporator when the heat pump cycle is operated in the cooling mode and as a condenser when the heat pump cycle is operated in the heating mode. To facilitate use of the heat exchanger of the invention in a heat pump cycle, the flow restriction ports 56 are profiled, as depicted in FIG. 11, rather than straight walled. By profiling the flow restriction ports, the magnitude of the pressure drop through the ports 56 will depend upon the direction in which the refrigerant is flowing through the ports.

With respect to heat exchanger 10A, which would be the outdoor heat exchanger in a heat pump application, the refrigerant will flow through the flow restriction ports in the direction 4 when the heat pump cycle is operating in the cooling mode and heat exchanger 10A is functioning as a condenser, and in the direction 2 when the heat pump cycle is operating in a heating mode and the heat exchanger 10A is functioning as an evaporator. Conversely, with respect to heat exchanger 10B, which would be the indoor heat exchanger in a heat pump application, the refrigerant will flow through the flow restriction ports in the direction 2 when the heat pump cycle is operating in the cooling mode and the heat exchanger 10B is functioning as an evaporator, and in the direction 4 when the heat pump cycle is operating in a heating mode and the heat exchanger 10B is functioning as a condenser. Therefore, when either heat exchanger 10A, 10B is functioning as an evaporator, the refrigerant is flowing in the direction 2 through the flow restriction orifices and will pass through a pair of sharp edge orifices, which will result in a relatively large pressure drop. However, when either heat exchanger 10A, 10B is functioning as a condenser, the refrigerant is flowing in the direction 4 through the flow restriction orifice and will pass through a pair of contoured orifices, which will result in a relatively small pressure drop. Further, when a heat exchanger functions as an evaporator, the expansion occurs before the refrigerant pass through the heat exchange tubes, while when a heat exchanger functions as a condenser, the expansion occurs after the refrigerant has passed through the heat exchange tubes.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A heat exchanger comprising:

a header defining a fluid chamber for collecting a fluid; and at least one heat exchange tube defining a plurality of discrete fluid flow paths therethrough and having an inlet opening to said plurality of fluid flow paths; and a connector having an inlet end and an outlet end and defining an inlet chamber at said inlet end in fluid flow communication with the fluid chamber of said header, an outlet chamber at said outlet end in fluid communication with the inlet opening of said at least one heat exchange tube, and an intermediate chamber defining a flow path between said inlet chamber and said outlet chamber, said flow path having a plurality of flow restriction ports disposed therein in a spaced series arrangement.

2. A heat exchanger as recited in claim 1 wherein each flow restriction port of said plurality of flow restriction ports comprises an expansion orifice.

3. A heat exchanger as recited in claim 2 wherein each flow restriction port of said plurality of flow restriction ports comprises a straight walled, cylindrical opening.

4. A heat exchanger as recited in claim 2 wherein each flow restriction port of said plurality of flow restriction ports comprises a contoured opening.

5. A heat exchanger as recited in claim 1 wherein said at least one heat exchange tube has a flattened, rectangular cross-section.

6. A heat exchanger as recited in claim 1 wherein each of said plurality of channels defines a flow path having a non-circular cross-section.

7. A heat exchanger as recited in claim 6 wherein each of said plurality of channels defines a flow path is selected from a group of a rectangular, triangular or trapezoidal cross-section.

8. A heat exchanger as recited in claim 1 wherein each of said plurality of channels defines a flow path having a circular cross-section.

9. A refrigerant vapor compression system comprising:

a compressor, a condenser and an evaporative heat exchanger connected in fluid flow communication in a refrigerant circuit whereby high pressure refrigerant vapor passes from said compressor to said condenser, high pressure refrigerant passes from said condenser to said evaporative heat exchanger, and low pressure refrigerant vapor passes from said evaporative heat exchanger to said compressor; characterized in that said evaporative heat exchanger includes:

an inlet header and an outlet header, each in fluid flow communication with the refrigerant circuit, said inlet header defining a chamber for receiving refrigerant from the refrigerant circuit;

at least one heat exchange tube having an inlet opening and an outlet opening and having a plurality of discrete fluid flow paths extending from the inlet opening to the outlet opening, the outlet opening in fluid flow communication with said outlet header; and a connector having an inlet end and an outlet end and defining an inlet chamber at said inlet end in fluid flow communication with the fluid chamber of said header, an outlet chamber at said outlet end in fluid communication with the inlet opening of said at least one heat exchange tube, and an intermediate chamber defining a flow path between said inlet chamber and said outlet chamber, said flow path having a plurality of flow restriction ports disposed therein in a spaced series arrangement.

10. A heat exchanger as recited in claim 9 wherein each flow restriction port of said plurality of flow restriction ports comprises an expansion orifice.

11. A heat exchanger as recited in claim 10 wherein each flow restriction port of said plurality of flow restriction ports comprises a straight walled, cylindrical opening.

12. A heat exchanger as recited in claim 10 wherein each flow restriction port of said plurality of flow restriction ports comprises a contoured opening.

13. A refrigerant vapor compression system as recited in claim 9 wherein said at least one heat exchange tube has a flattened, rectangular cross-section.

14. A refrigerant vapor compression system as recited in claim 9 wherein said heat exchanger comprises a single-pass heat exchanger.

15. A refrigerant vapor compression system as recited in claim 9 wherein said heat exchanger comprises a multi-pass heat exchanger.

16. A refrigerant vapor compression system as recited in claim 9 wherein said heat exchanger comprises a condenser.

17. A refrigerant vapor compression system as recited in claim 9 wherein said heat exchanger comprises an evaporator.

18. A refrigerant vapor compression system comprising:

a compressor, a first heat exchanger and a second heat exchanger connected in fluid flow communication in a refrigerant circuit whereby a refrigerant circulates in a first direction in a cooling mode from said compressor through said first heat exchanger, thence through said second high exchanger and back to said compressor, and circulates in a second direction in a heating mode from said compressor through said second heat exchanger, thence through said first heat exchanger and back to said compressor; characterized in that said second heat exchanger includes:

a first header and a second header, each in fluid flow communication with the refrigerant circuit, said first header defining a fluid chamber for receiving refrigerant from the refrigerant circuit flowing in the first direction and said second header defining a chamber for receiving refrigerant from the refrigerant circuit flowing in a second direction;

at least one heat exchange tube having a first end and a second end and a plurality of discrete fluid flow paths extending between the first end and the second end, the plurality of discrete fluid flow paths in fluid flow communication between the fluid chamber of said first header and the fluid chamber of said second header;

a connector having an inlet end and an outlet end and defining an inlet chamber at said inlet end in fluid flow communication with the fluid chamber of said first header, an outlet chamber at said outlet end in fluid communication with the plurality of discrete fluid flow paths of said at least one heat exchange tube, and an intermediate chamber defining a flow path between said inlet chamber and said outlet chamber, said flow path having a plurality of flow restriction ports disposed therein in a spaced series arrangement and adapted to create a relatively large pressure drop in refrigerant flow passing in the first direction and a relatively small pressure drop in refrigerant flow passing in the second direction.

19. A refrigerant vapor compression system comprising:

a compressor, a first heat exchanger and a second heat exchanger connected in fluid flow communication in a refrigerant circuit whereby a refrigerant circulates in a first direction in a cooling mode from said compressor through said first heat exchanger, thence through said second high exchanger and back to said compressor, and circulates in a second direction in a heating mode from said compressor through said second heat exchanger, thence through said first heat exchanger and back to said compressor; characterized in that said first heat exchanger includes:

a first header and a second header, each in fluid flow communication with the refrigerant circuit, said first header defining a fluid chamber for receiving refrigerant from the refrigerant circuit flowing in the first direction and said second header defining a chamber for receiving refrigerant from the refrigerant circuit flowing in a second direction;

at least one heat exchange tube having a first end and a second end and a plurality of discrete fluid flow paths extending between the first end and the second end, the plurality of discrete fluid flow paths in fluid flow communication between the fluid chamber of said first header and the fluid chamber of said second header;

a connector having an inlet end and an outlet end and defining an inlet chamber at said inlet end in fluid flow communication with the fluid chamber of said second header, an outlet chamber at said outlet end in fluid communication with the plurality of discrete fluid flow paths of said at least one heat exchange tube, and an intermediate chamber defining a flow path between said inlet chamber and said outlet chamber, said flow path having a plurality of flow restriction ports disposed therein in a spaced series arrangement and adapted to create a relatively small pressure drop in refrigerant flow passing in the first direction and a relatively large pressure drop in refrigerant flow passing in the second direction.

* * * * *